US005768850A

United States Patent [19]

Chen

[11] Patent Number: 5,768,850

[45] Date of Patent: Jun. 23, 1998

[54] METHOD FOR ERECTING FLOOR BOARDS AND A BOARD ASSEMBLY USING THE METHOD

[76] Inventor: Alen Chen, No. 361-2, Sec. 3, Shenyang Rd., Peitun Dist., Taichung, Taiwan

[21] Appl. No.: 794,807

[22] Filed: Feb. 4, 1997

[51] Int. Cl.[6] ..... E04B 5/00; E04F 15/00

[52] U.S. Cl. ..... 52/747.1; 52/480; 52/506.05; 52/506.1; 52/745.05; 403/386; 403/387; 403/397

[58] Field of Search ..... 52/403.1, 480, 52/506.01, 506.05, 506.06, 506.8, 506.09, 506.1, 588.1, 745.05, 745.06, 747.1, 747.12; 403/386, 387, 389, 397

[56] References Cited

U.S. PATENT DOCUMENTS

| | | | |
|---|---|---|---|
| 1,898,364 | 2/1933 | Gynn | 52/512 |
| 1,974,259 | 9/1934 | Cherry | 52/506.1 |
| 2,004,917 | 6/1935 | Johnson | 52/506.1 |
| 2,046,593 | 7/1936 | Urbain | 52/506.1 |
| 3,267,630 | 8/1966 | Omholt | 52/506.1 |
| 3,619,963 | 11/1971 | Omholt | 52/480 X |
| 5,520,477 | 5/1996 | Fink | 403/397 |

*Primary Examiner*—Carl D. Friedman
*Assistant Examiner*—Kevin D. Wilkens
*Attorney, Agent, or Firm*—William E. Pelton

[57] ABSTRACT

A method for assembling floor boards includes the steps of: (a) providing a supporting joist fixedly mounted on a floor; (b) providing a plurality of floor boards on the supporting joist; (c) providing a plurality of fastener members each mounted on the supporting joist for securing each of the floor boards on the supporting joist; and (d) combining each of the floor boards consecutively.

4 Claims, 8 Drawing Sheets

METHOD FOR ERECTING FLOOR BOARDS AND A BOARD ASSEMBLY USING THE METHOD

FIELD OF THE INVENTION

The present invention relates to a method for erecting floor boards and to a floor board assembly.

BACKGROUND OF THE INVENTION

A conventional floor board assembly is shown in FIG. 12, and there will be a complete illustration in the detailed description of the preferred embodiments.

The present invention has arisen to mitigate and/or obviate the disadvantage of the conventional floor board assembly.

SUMMARY OF THE INVENTION

In accordance with one aspect of the present invention, there is provided a method for assembling floor boards and comprising the steps of: (a) providing a supporting joist fixedly mounted on a floor; (b) providing a plurality of floor boards on the supporting joist; (c) providing a plurality of fastener members each mounted on the supporting joist for securing each of the floor boards on the supporting joist; and (d) assembling each of the plurality of floor boards consecutively.

Further features of the present invention will become apparent from a careful reading of the detailed description with appropriate reference to the accompanying drawings.

DETAILED DESCRIPTION OF THE PREFERRED EMBODIMENTS

Figure 12:
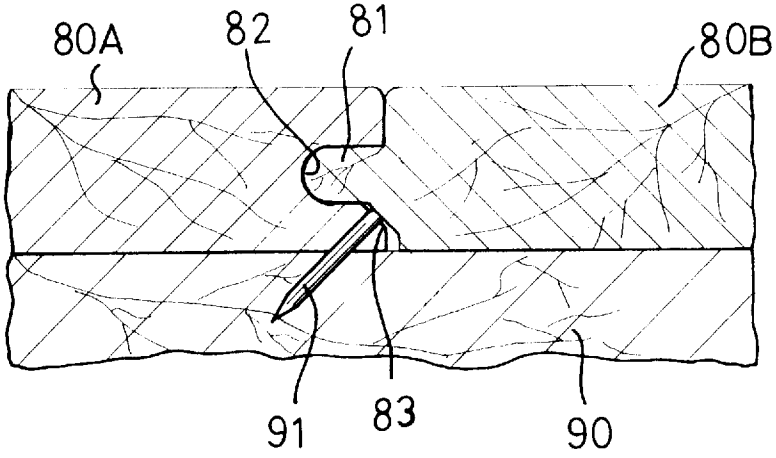
FIG. 12 PRIOR ART
FIG. 12 is a side cross-sectional assembly view of a conventional floor board assembly in accordance with the prior art.

For a better understanding of features and benefits of the present invention, reference is made to FIG. 12, illustrating a conventional floor board assembly in accordance with the prior art. The floor board assembly comprises a plurality of floor boards 80 each having a first end portion with a tongue 81 protruding outwardly, and second end portion with a groove 82 defined therein.

In assembly, a first floor board 80A is initially fixedly mounted on a floor 90 by means of such as a nail 91.

Then, a second floor board 80B is juxtaposed to the first floor board 80A with the tongue 81 of the second floor board 80B being fitted into the groove 82 of the first floor board 80A. The above-mentioned procedures can be repeated, thereby constructing the floor board assembly.

By such an arrangement, however, any adjacent two floor boards 80 will squeeze with each other due to a heat expansion such that the floor board assembly easily develops a corrugated form thereby greatly reducing the aesthetic quality of the floor board assembly.

Referring now to FIGS. 1–5, a method in accordance with the present invention is provided for combining floor boards and comprises the steps of (a) providing a supporting joist 40 fixedly mounted on a floor 30; (b) providing a plurality of floor boards 70 on the supporting joist 40; (c) providing a plurality of fastener members 20 each mounted on the supporting joist 40 for securing each of the floor boards 70 on the supporting joist 40; and (d) assembling each of the plurality of floor boards 70 consecutively.

Figure 1:
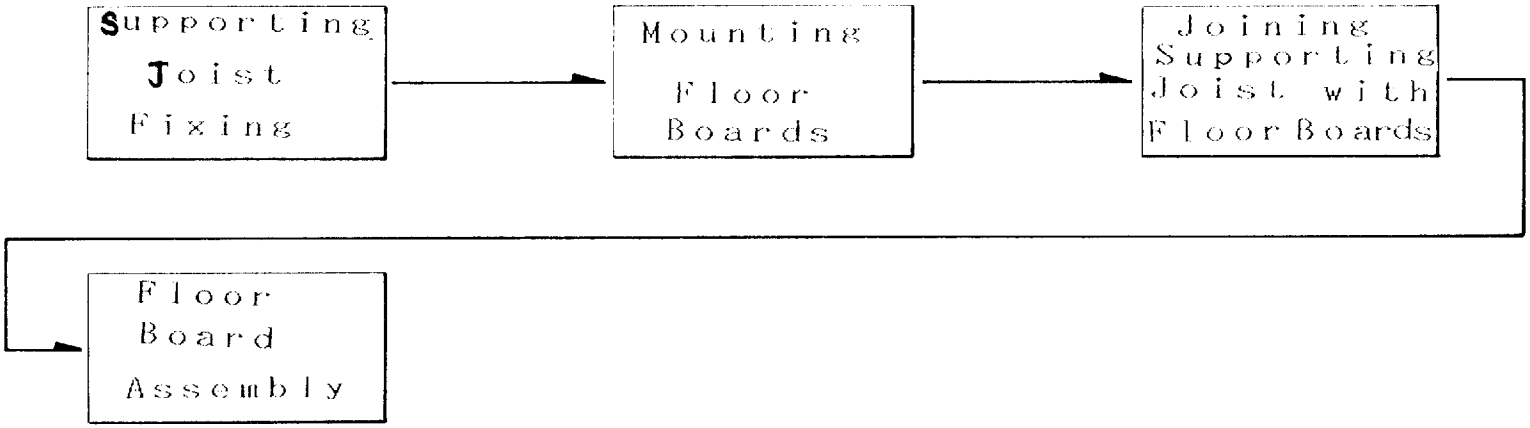
FIG. 1 flow chart of a method in accordance with the present invention.
Figure 2:
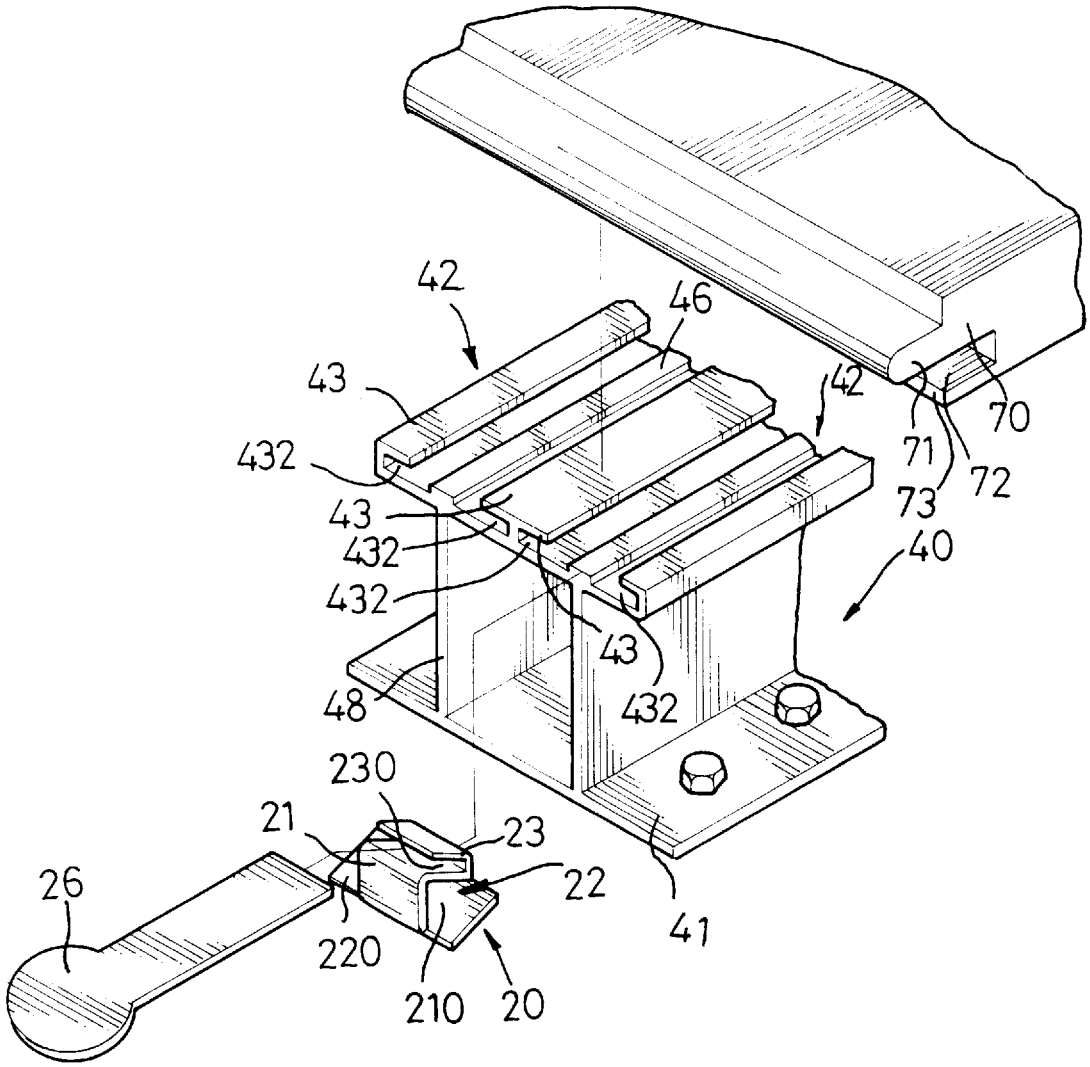
FIG. 2 is an exploded view of a floor board assembly in accordance with the present invention.
Figure 3:
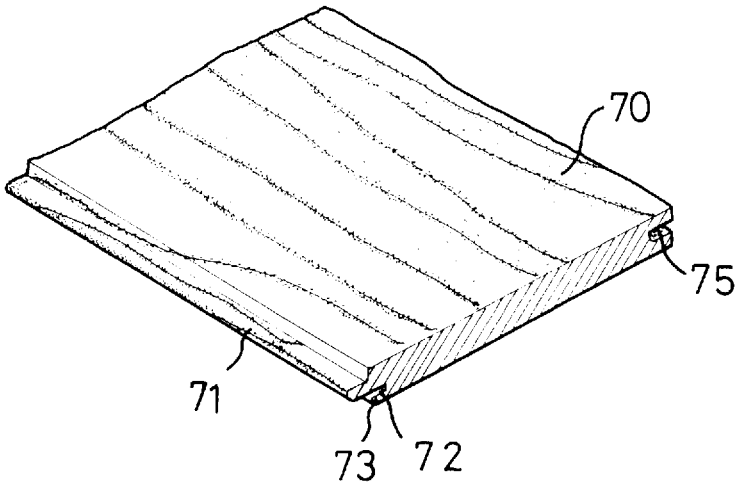
FIG. 3 is a perspective view of a floor board.
Figure 4:
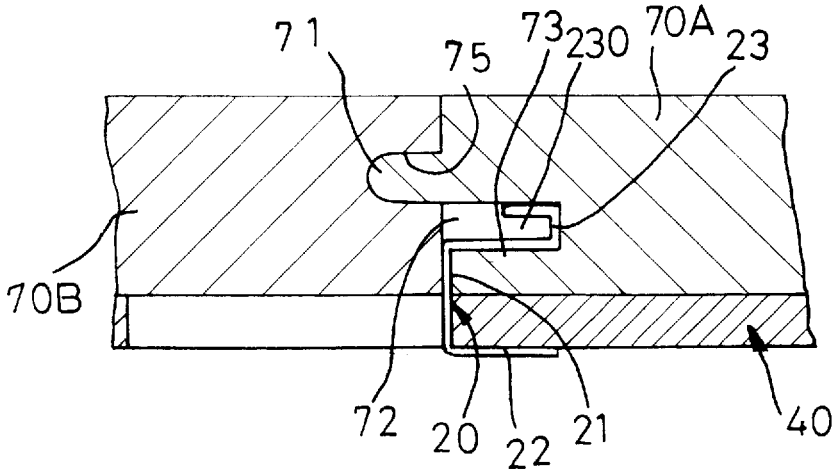
FIG. 4 is a side cross-sectional assembly view of FIG. 2.

Each of the floor boards 70 includes a first end portion with a tongue 71 protruding outwardly, a bottom plate 73 located under the tongue 71, and a groove 72 defined between the tongue 71 and the bottom plate 73, and includes a second end portion with a recess 75 laterally defined therein. The tongue 71 of each of the floor boards 70 can be received in the recess 75 of an adjacent floor board 70 as shown in FIG. 4.

The supporting joist 40 is substantially shaped as the roman numeral"II" and includes a bottom portion 41 fixedly mounted on the floor 30 and a top portion forming two longitudinal brackets 42. Each of the two brackets 42 has two sides each with an inwardly hooked flange 43 formed thereon. Each of the two flanges 43 has a slot 432 defined therein, each of the two slots 432 facing each other. An elongate ridge 46 is formed on a mediate portion of the bracket 42 and located between the respective two flanges 43.

Each of the fastener members 20 includes a plate 22 supported on the ridge 46 of the bracket 42 and has two side edges 220 each received in a corresponding one of the two slot 432. A pressing member 21 substantially shaped as a question mark "?" extends from the plate 22 and has an opening 210 defined between it and the plate 22 for securely receiving the bottom plate 73 of the floor board 70 therein.

The pressing member 21 has a top section forming a hook A space 230 is defined in the hook 23 and faces opposite to the opening 210. An auxiliary bar 26 has one distal end detachably received in the space 230 to lever open further the opening 210 to receive the bottom plate 73 of the floor board 70.

In operation, referring to FIGS. 2–5, the fastener members 20 can be initially received in each of the brackets 42 of the supporting joist 40 with the side edges 220 of each of the plates 22 being received in the grooves 432 and limited by the flanges 43.

Then, a first floor board 70A can be supported on the brackets 42 of the supporting joist 40 with the bottom plate 73 abutting on the flanges 43 and with the tongue 71 being located above the flanges 43.

The auxiliary bar 26 can then be inserted into the space 230 to lever open further the opening 210 to receive the bottom plate 73 therein, thereby securing the first floor board 70A on the supporting joist 40.

Finally, a second floor board 70B can be supported on the brackets 42 of the supporting joist 40 with the tongue 71 of the first floor board 70A being received in the recess 75 of the second floor board 70B, thereby assembling the first and the second floor boards 70A and 70B together.

The above-mentioned procedures can be repeated, thereby assembling the floor boards 70 into a floor board assembly.

Figure 5:
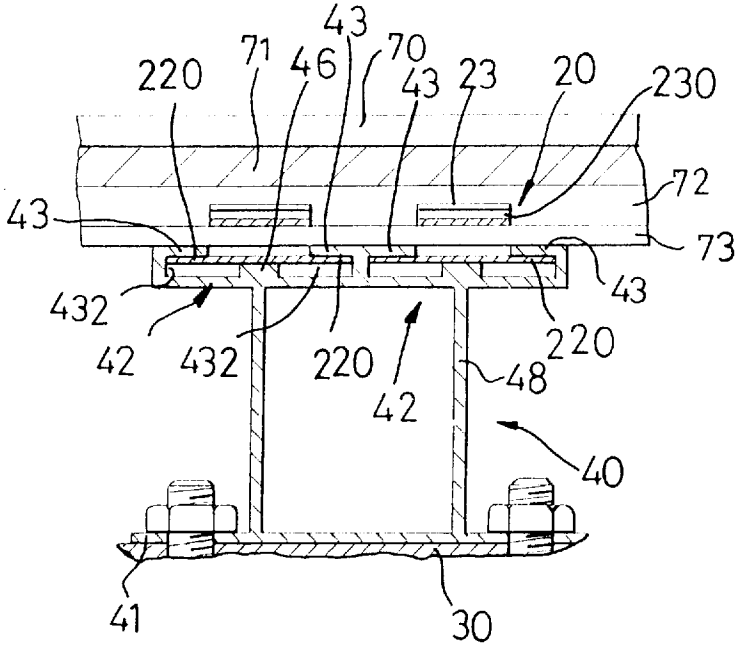
FIG. 5 is a front plan cross-sectional assembly view of FIG. 2.

Referring to FIG. 5, the supporting joist 40 can be disposed in an elevated manner with a connecting strut 48 mounted between the bottom portion 41 and the top portion.

Figure 6:
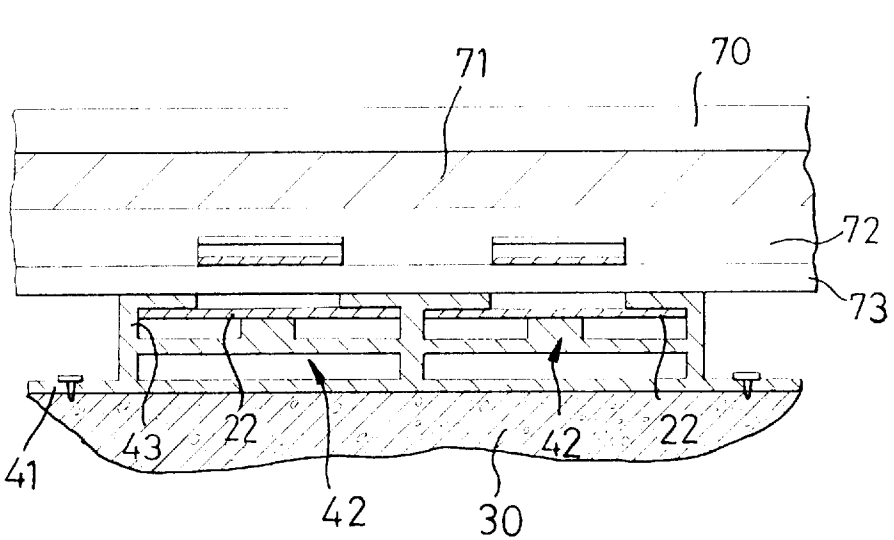
FIGS. 6 and 7 show two different forms of supporting joists.

Referring to FIG. 6, the connecting strut 48 is removed.

Figure 7:
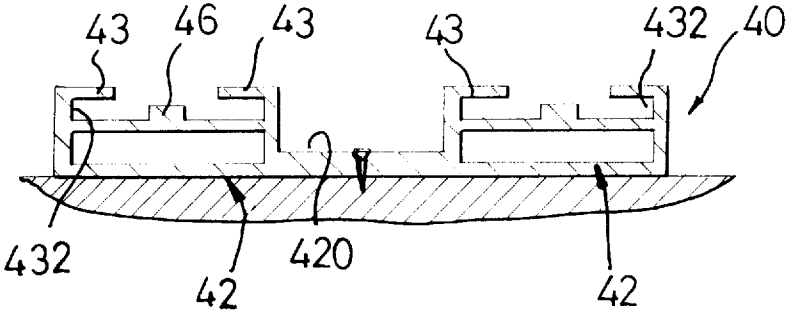
Figure 11:
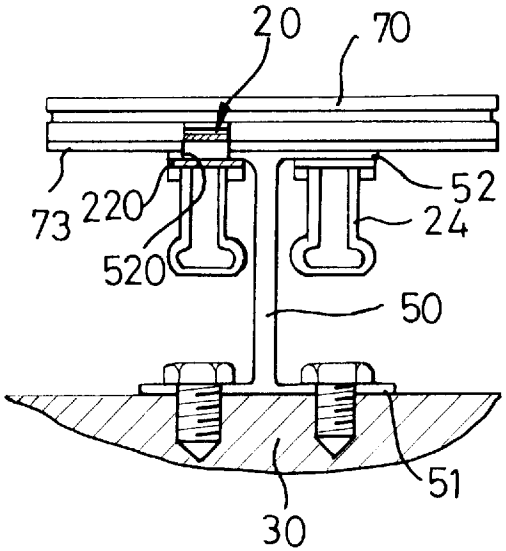
FIG. 11 is a front plan cross-sectional view of FIG. 8.
Figure 8:
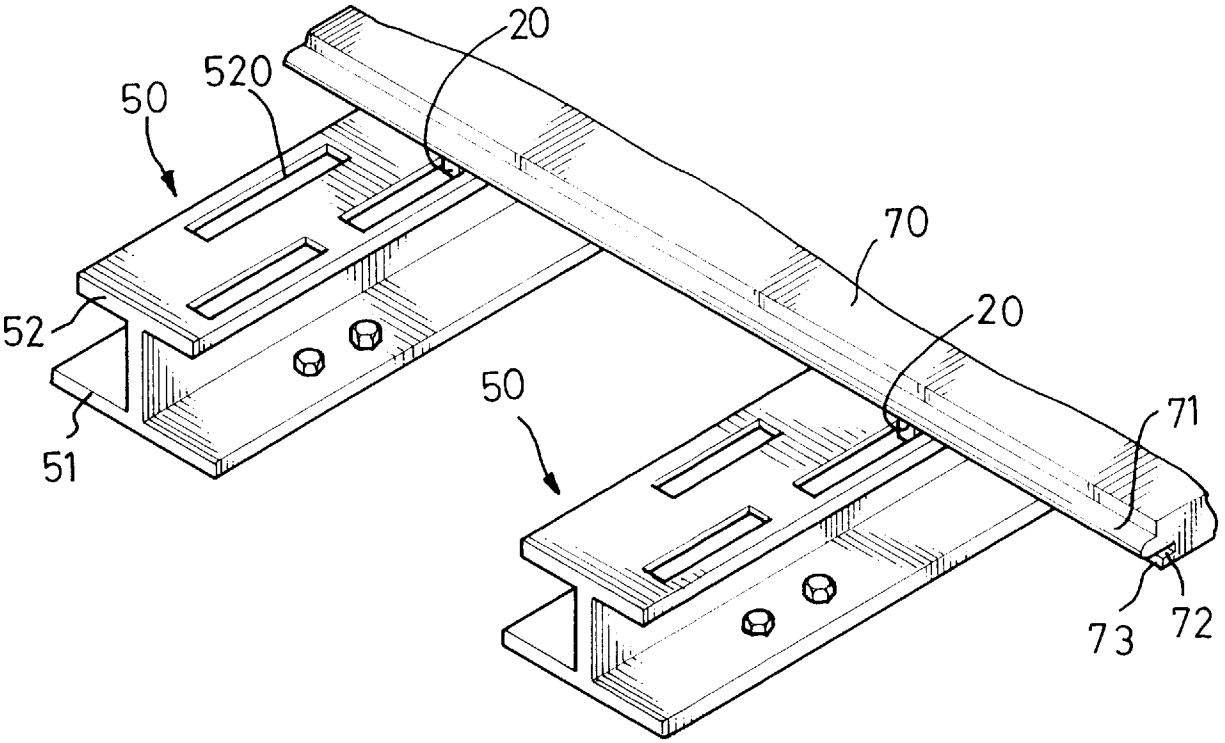
FIG. 8. is an assembly view of a floor board assembly according to a second embodiment of the present invention.
Figure 9:
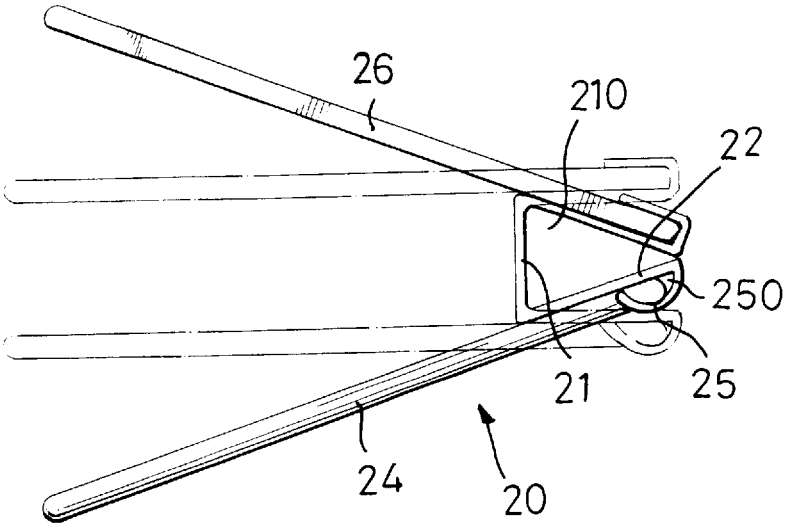
FIG. 9 shows a fastener member.
Figure 10:
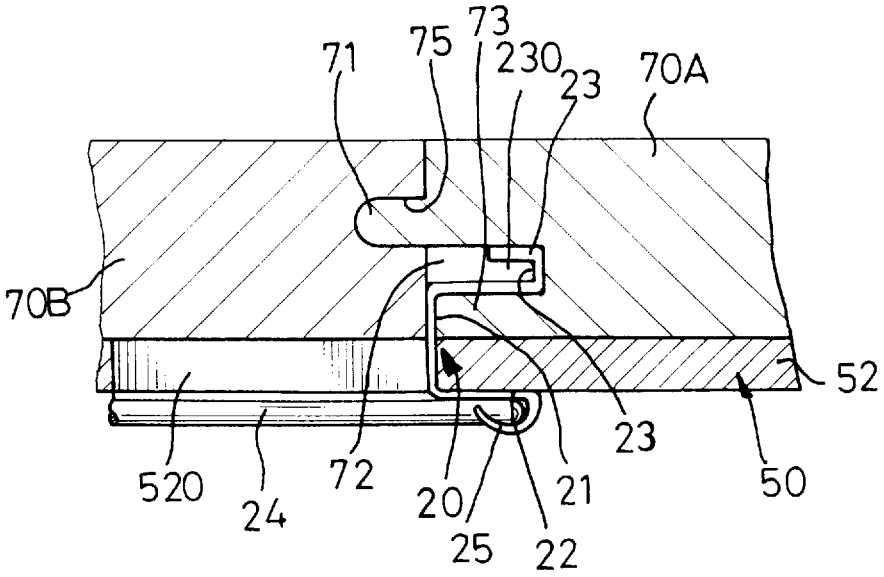
FIG. 10 is a side cross-sectional view of FIG. 8.

Referring to FIG. 7, each of the brackets 42 is spaced apart from each other with a space 420 defined therebetween.

Referring to FIGS. 8-11, in accordance with another embodiment of the present invention, a plurality of I-shaped supporting joists 50 each include a bottom portion 51 fixedly mounted on the floor 30 and a top portion forming a supporting beam 52 with a plurality of pairs of alternate elongate slots 520 defined therein.

The plate 22 of each of the fastener members 20 abuts on an underside of the supporting beam 52, and the inverted L-shaped pressing member 21 extends through the elongate slot 520 with the opening 210 receiving the bottom plate 73 of the floor board 70 therein.

The plate 22 has an underside forming a hook 25, a space 250 defined in the hook 25 and facing opposite to the opening 210, and a second auxiliary bar 24 having one distal end received in the space 250.

In operation, a user can exert a force on the first auxiliary bar 26 and the second auxiliary bar 24, thereby expanding the opening 210 for receiving the bottom plate 73 of the floor board 70.

It should be clear to those skilled in the art that further embodiments of the present invention may be made without departing from the spirit and scope of the present invention.

What is claimed is:

1. A method for assembling floor boards and comprising the steps of:

(a) providing a supporting joist fixedly mounted on a floor, said supporting joist including a bottom portion fixedly mounted on said floor and a top portion forming a supporting beam defining a plurality of elongate slots therein;

(b) providing a plurality of floor boards on said supporting joist, each of said floor boards including a first end portion with a tongue protruding outwardly, a bottom plate located under said tongue, and a groove defined between said tongue and said bottom plate, and including a second end portion defining a recess therein, (c) providing a plurality of fastener members each mounted on said supporting joist for securing each of said floor boards on said supporting joist, each of said fastener members including a plate abutting on an underside of said supporting beam, a question mark-shaped pressing member formed on said plate and received in a corresponding one of said elongate slots, and an opening defined between said plate and said pressing member with each said bottom plate of each said floor board securely received in a respective said opening; and and (d) assembling each of said plurality of floor boards consecutively by forcing said tongue of each of said floor boards into said recess of an adjacent floor board.

2. The method in accordance with claim 1, wherein said question mark-shaped pressing member has a top section forming a hook, a space defined in said hook and facing a direction opposite to said opening, and a bar having one distal end detachably received in said space for exerting a torque on said hook to lever open said opening for receiving said bottom plate of said floor board therein, said bar being able to detach from said space of said hook of each of said fastener members when said bottom plate of said floor board is received in said opening.

3. The method in accordance with claim 2, wherein said plate has an underside forming a second hook, a second space defined in said second hook and facing a direction opposite to said opening, and a second bar having one distal end securely received in said second space for exerting a torgue on said second hook to lever open said opening for receiving said bottom plate of said floor board therein.

4. A method for assembling floor boards and comprising the steps of:

(a) providing a supporting joist, having a bottom portion fixedly mounted on a floor and a top portion forming at least one longitudinal bracket having two sides facing each other each formed with an inwardly-hooked flange defining a slot, and an elongate ridge formed on said bracket and located between said flanges of said two sides;

(b) providing a plurality of floor boards on said supporting joist, each of said floor boards including a first end portion with a tongue protruding outwardly, a bottom plate located under said tongue, and a groove defined between said tongue and said bottom plate, and including a second end portion defining a recess therein;

(c) providing a plurality of fastener members each mounted on said supporting joist for securing each of said floor boards on said supporting joists, each of said fastener members including a plate supported on said ridge of said bracket and having two side edges each received in said slot, a question mark-shaped pressing member formed on said plate and defining an opening between said plate and said pressing member with each said bottom plate of each said floor board securely recieved in a respective said opening said question mark-shaped pressing member including a top section forming a hook defining a space facing a direction opposite to said opening, and a bar having one distal end detachably received in said space for exerting a torque on said hook to lever open said opening for receiving each said respective bottom plate of said floor boards therein;

(d) detaching said bar from said space of said hook of each of said fastener members when each said bottom plate of each said floor board is received in each said opening; and (e) assembling each of said plurality of floor boards consecutively by forcing said tongue of each of said floor boards into said recess of an adjacent floor board.

* * * * *